United States Patent [19]

Churchward

[11] 4,043,563

[45] Aug. 23, 1977

[54] GOLF CLUB

[76] Inventor: Roy Alexander Churchward, 6444-19th Ave. S., Richfield, Minn. 55423

[21] Appl. No.: 629,277

[22] Filed: Nov. 6, 1975

Related U.S. Application Data

[63] Continuation-in-part of Ser. No. 423,080, Dec. 10, 1973, which is a continuation-in-part of Ser. No. 277,739, Aug. 3, 1972, abandoned.

[51] Int. Cl.[2] ..... A63B 53/08

[52] U.S. Cl. ..... 273/171; 273/172

[58] Field of Search ..... 273/167–174

[56] References Cited

U.S. PATENT DOCUMENTS

| | | | |
|---|---|---|---|
| 1,213,382 | 1/1917 | Kent | 273/174 X |
| 1,467,435 | 9/1923 | Kinnear | 273/173 X |
| 1,598,050 | 8/1926 | Butchart | 273/174 |
| 2,163,091 | 6/1939 | Held | 273/171 |
| 2,328,583 | 9/1943 | Reach | 273/171 |
| 2,332,342 | 10/1943 | Reach | 273/174 X |
| 3,143,349 | 8/1964 | MacIntyre | 273/171 |
| 3,466,047 | 9/1969 | Rodia et al. | 273/171 |
| 3,761,095 | 9/1973 | Thompson | 273/172 X |

FOREIGN PATENT DOCUMENTS

| | | | |
|---|---|---|---|
| 105,959 | 11/1938 | Australia | 273/171 |
| 347,502 | 4/1931 | United Kingdom | 273/171 |

*Primary Examiner*—Richard J. Apley
*Attorney, Agent, or Firm*—Norman P. Friederichs

[57] ABSTRACT

A golf club having an impact block disclosed in the bottom portion of the club head. The impact block has a plurality of openings therein for slidably receiving weights therein. A removable cap provides access to the weights. The impact block could be made integral with the sole plate.

8 Claims, 10 Drawing Figures

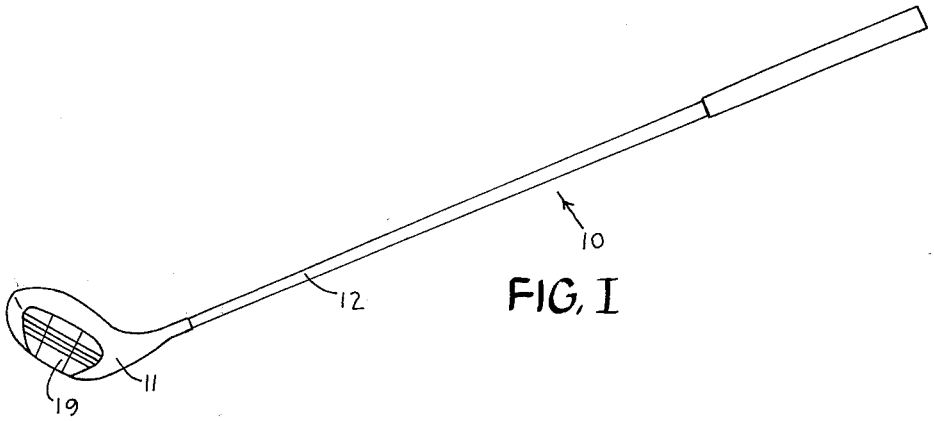
FIG. I
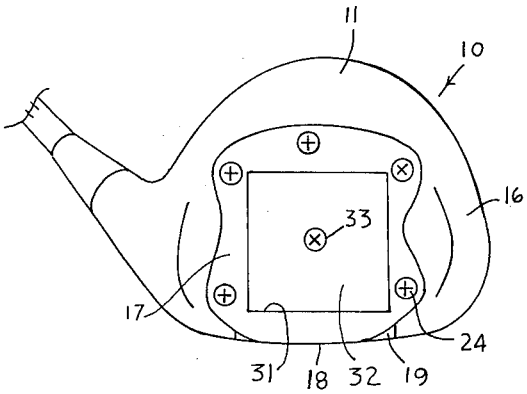
FIG. II
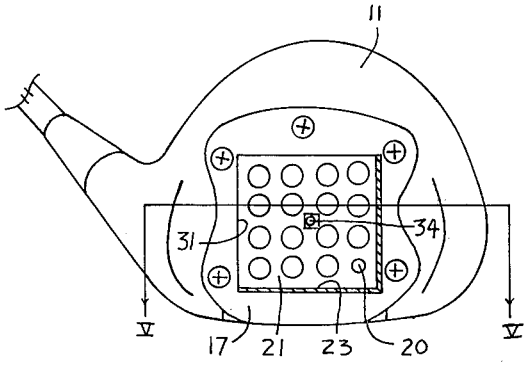
FIG. III
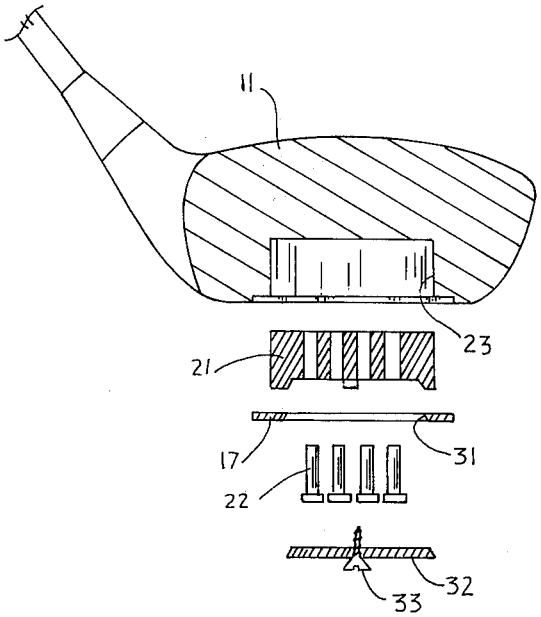
FIG. V
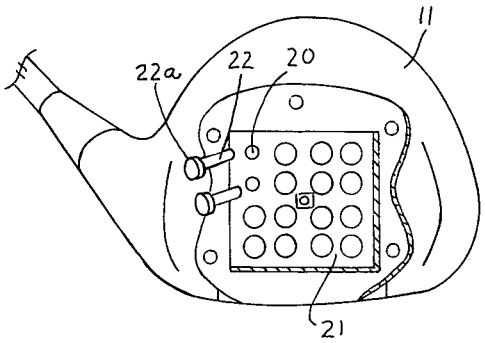
FIG. IV

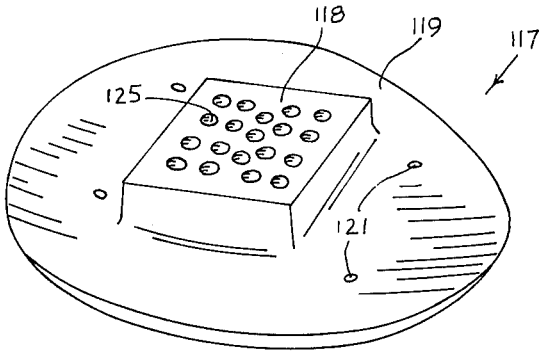
FIG. VI
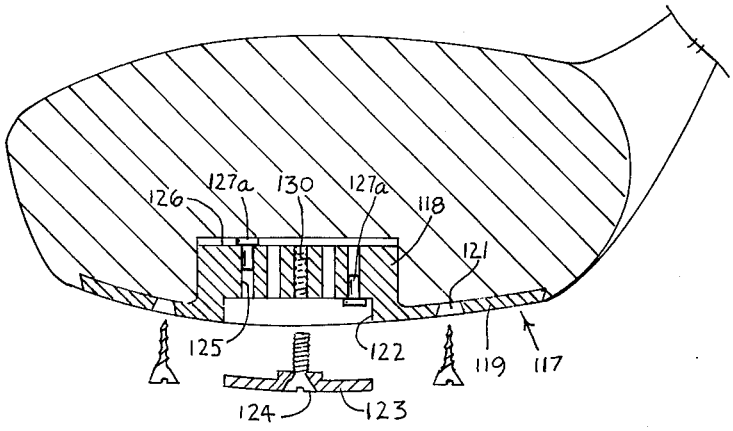
FIG. VII
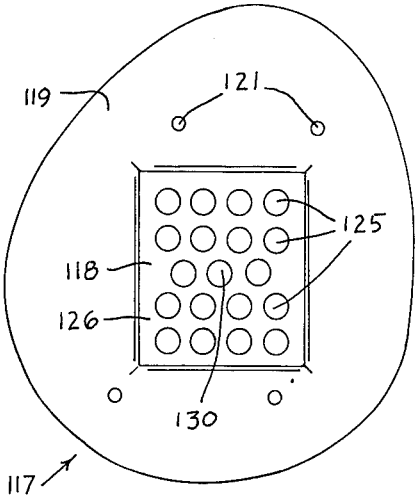
FIG. VIII
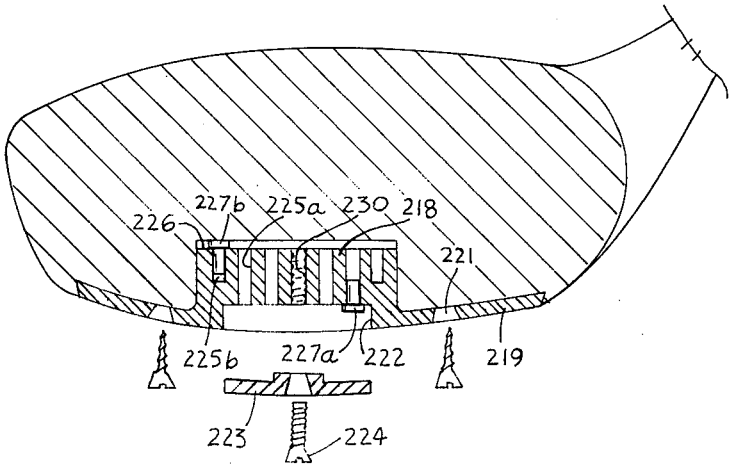
FIG. X
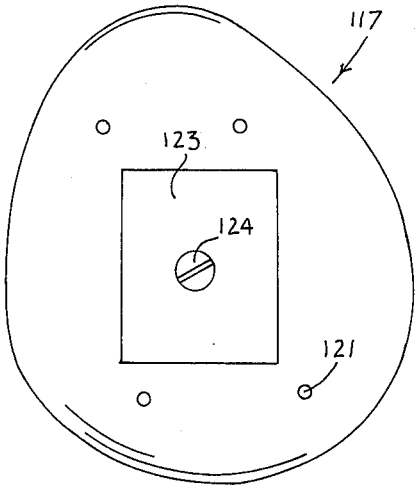
FIG. IX

GOLF CLUB

This application is a continuation-in-part of U.S. patent application Ser. No. 423,080 filed Dec. 10, 1973, which is a continuation-in-part of U.S. patent application Ser. No. 277,739 filed Aug. 3, 1972, now abandoned.

The present invention relates to sporting goods and more particularly to an improved golf club.

Golf is a sport that is highly enjoyable to the expert, as well as the beginner. Both the expert and the beginner desire clubs that are suitably weighted and balanced to satisfy the particular individual. All have experienced the frustration of the curving golf ball. The ball is said to hook when the golf ball is struck by a right-handed golfer and curves to the left during flight. On the other hand, the ball is said to slice if the same golfer strikes the ball and the ball curves to the right. In the past much effort has been expended in order to overcome the hook or slice. For example, grips have been designed to remind the golfer that the club must be held properly to strike the ball properly. In other words, the ball must be struck such that the club face is neither excessively open nor excessively closed.

Effort has been expended through lessons and various types of apparatus to teach the golfer proper stance and proper swing. In spite of such effort, the hook and slice continue to bother many golfers in varying degrees.

Most golfers have experienced the satisfying "click" of the ball when struck with the so-called sweet spot of the golf club. Also most have experienced the frustrating "thud" when the sweet spot is missed.

One objective of the present invention is to provide an improved golf club that may be weight adjusted to substantially reduce or eliminate the problem of the hook or slice for most golfers.

A further object is to provide an improved golf club in which the center of gravity may be moved to the location where the individual golfer most often strikes the ball.

Another objective is to provide a golf club in which the center of gravity may be moved toward the toe of the club.

Another objective is provision of a golf club in which the center of gravity may be shifted toward the heel of the club.

An additional objective is to provide a golf club in which the center of gravity may be raised or lowered.

A further objective is to provide an improved golf club that can be readily weighted to provide heel and toe weighting.

IN THE DRAWING

FIG. I shows a golf club of the present invention;

FIG. II shows a perspective view of the lower side of the head of one embodiment of the present golf club;

FIG. III shows the lower side of the club head of FIG. II with the impact block cover removed;

FIG. IV shows the lower side of the club head with the sole plate removed;

FIG. V is a cross sectional view of the club head taken along the line V—V in FIG. III;

FIG. VI is a perspective view of one embodiment of the sole plate of the present invention;

FIG. VII is a cross sectional view of the sole plate of FIG. VI;

FIG. VIII is a top view of the sole plate of FIG. VI;

FIG. IX is a bottom view of the sole plate of FIG. VI;

FIG. X is a cross sectional view of an alternate embodiment of the sole plate.

DETAILED DESCRIPTION OF THE PRESENT INVENTION

The golf club 10 of the present invention (FIG. I) includes a club head 11, a shaft 12, and a handle or grip 13. The club 10 is of the type generally called a "wood." The shaft 12 is stiff, yet flexible, and typically is made of light weight tubular spring steel. The grip 13 is applied over the upper portion of the shaft 12 and typically consists of a wrapping of leather or rubber to provide a non-slip surface.

The club head 11 of a so-called "wood" is generally constructed of wood, such as persimmon or laminated wood; however, as used herein the term "wood" will also include clubs having heads of various other materials such as plastic or nylon. The club head 11 (FIG. II) has a body portion 16, a sole plate 17, and a face 18 including a face plate 19. The face 18, as shown, is generally slightly curved. The face plate 19 is inletted into the club head 11 to provide an even surface across the face 18. The face 18 of the club head 11 may have horizontal furrows to aid in control of the golf ball. The face plate 19 provides a hard wear resistant surface for striking the ball.

The club head 11 (FIG. III) of the present invention includes an impact block 21. The term "impact block" as used herein refers to weight disposed beneath the sole plate 17. The impact block 21 may be constructed of aluminum or other light weight material, for example, magnesium. Alternatively, the impact block 21 may be of any other material such as copper. The forward surface of the impact block 21 desireably is spaced within about $\frac{3}{8}$ to $\frac{1}{2}$ inch of the face of the club.

The impact block 21 may be of any desired shape and size. The impact block 21 is preferably a non-circular shape. The impact block 21 perferably is a matrix which has defined therein a plurality of openings 20 for reception of weights 22. The weights 22 may be of any desired size and weight; however, in one perferred embodiment each weight is equal to one lorythmic swing weight. In another preferred embodiment each weight may be equal to two lorythmic swing weights. By so doing a single club can be manufactured which at a later time can be weight-adjusted to provide, for example, a C-2 to an E-2 club. This substantially simplifies the manufacturing of golf clubs. Thus a single club may be manufactured which is capable of weight adjustment over the entire commonly used weight range. This eliminates the need for large inventories on the part of a golf pro shop.

In one embodiment the weights 22 for insertion in the impact block 21 may be cylindrical in shape and have a head portion **22*a* by which the weights may be grasped. The weights 22 may have a length that is very nearly the same as the length of the openings 20 in the impact block 21. The openings 20 desireably extend entirely through or very nearly through the impact block 21. Thus the weights 22 have a length that is approximately equal to the thickness of the impact block 21. In another embodiment the openings and the weights extend only through a portion of the impact block. The cylindrical weights alternatively may be a composite of two materials. In other words, one portion or end of the weight may be made of a heavy material such as copper and another portion or end of the weight may be light weight such as poly ethylene. The weight may be inserted with the heavy end down or alternatively with the heavy end up. This provides for vertical, as well as horizontal, adjustment of the weights. The weights 22 are slideably received in the openings 20 and not threadably engaged. Such slideable reception provides very significant advantage over threaded engagement. For example, adjustment of the amount of weight or location of weights may be quickly and easily made. Threaded screws, on the other hand, are very slow and somewhat difficult to change. The screws and screw slots may be stripped. Such problems are not encountered in the present invention. The present impact block 21 and weights 22 may be simply and efficiently manufactured. The impact block 21 may be manufactured from a metal block simply by drilling or punching the openings in the block. Threading such openings would make such manufacture complicated and expensive. The weights 22** may simply be metal rod material cut to the appropriate length to provide headless weights. The rod material may be standard copper rod which is readily and widely available. Further, no special tools are necessary to either manufacture or change such weights.

The openings 20 may be in a grouped array such that the golfer may recall which openings he normally has filled with the weights 22, thus giving the individual golfer a base point from which to adjust the weights locations. The openings 20 are perferably a series of aligned openings. The grouped array may be at least four rows of openings, each row having at least four openings.

The club head 11 has a cavity 23 defined therein for snug reception of the impact block 21. In the assembled club 10, the impact block 21 fits just beneath the sole plate 17 which in turn is secured to the club head 11 such as by screws 24. The impact block 21 and weights 22 are held in place by the sole plate 17 and is substantially covered by such plate.

The impact block 21 desireably has a low horizontal profile and is located close to the sole plate 17 so that the center of gravity is lowered in the club head 11, thus lowering the so-called "sweet spot" or ideal area of impact on the face of the club. The impact block 21, for example, may be disposed if desired in the lower 25% of the club head 11. The impact block 21 may be a copper bar stock having a thickness of about 3/16 inches. Such lowering of the "sweet spot" and/or low horizontal profile of the impact block creates greater velocity in the club head without increasing the golfer's normal swing and therefore greater distance. The sole plate 17 has an opening 31 therein which is slightly smaller in size than impact block 21. Access to weights 22 is provided through opening 31. A cover 32 is normally held in place over opening 31 by a screw 33 which is threadedly engaged in opening 34 in impact block 21.

One perferred embodiment of the present invention includes sole plate 117 which is shown in FIGS. VI through IX. The sole plate 117 has a thickened central portion 118 and a thin plate-like portion 119. Portion 118 is integral with portion 119. The portion 118 may be, for example, square in horizontal profile (i.e. as viewed in FIG. VIII). The portion 119 may include a plurality of openings 121 through which screws may extend for securing the sole plate 117 to the club head.

The sole plate 117 includes a recess 122 (FIG. VII) in the lower surface thereof. The recess 122 may be aligned with portion 118 and may be of slightly smaller size than portion 118, see FIG. VII. A cap 123 may be snugly fitted into recess 122 and held in place by a screw 124. Screw 124 may be engaged in threaded opening 130 in portion 118.

The portion 118 may include a plurality of openings 125 which may extend from the upper surface 126 of portion 118 to the recess 122. As shown in FIG. VII, weights **127*a* may be inserted into openings 125 from the upper surface 126 or weights 127*b* may be inserted into openings 125 through recess 122. This enables raising of the center of gravity by inserting the weights 127*a* from above or lowering the center of gravity by insertion of the weights 127*b* from beneath. The weights 127*a* and 127*b* also may be moved toward the heel or toe as previously described with regard to embodiment 11. Insertion of weights 127*a* from above necessitates removal of the sole plate 117 from the club head; whereas, insertion of weights 127*b* through recess 122 only requires removal of the cap 123. Thus, the weights inserted from above may be considered semi-permanent weights. The weights inserted through recess 122** may be considered ready access weights. The semi-permanent weights may be used for gross or major weight adjustment; whereas, ready access weights may be used for fine adjustment.

A further embodiment 217 of the sole plate is shown in cross section in FIG. X. Sole plate 217 has a thickened central portion 218 and a thin portion 219. The portion 219 may include a plurality of openings 221 through which screws may extend for securing the sole plate 217 to the club head 211. The thickened portion 218 has a first set of openings **225*a* extending from the upper surface 226 of portion 218 to the recess 222. The portion 218 has a second set of openings 225*b* which extend only part way through portion 218. In other words, the openings 225*b* begin at the upper surface 226 of portion 218 and extend to a point above the lower surface of sole plate 218. The openings 225*b* may include a first row along the heel side of portion 218 and a second row along the toe side of portion 218 as shown in FIG. X. Heel and toe weighting may be provided by filling both rows of openings 225*b*** with weights. Heel and toe weighting spreads the weights of the club head increasing the size of the sweet spot.

A cap 223 may be secured in place in recess 222 by screw 224 which is engaged in opening 230. The weights **227*a*, which are inserted in openings 225*a*, are ready access weights and may be used for fine weight adjustment. Weights 227*b* inserted in openings 225*b*** are semi-permanent weights and may be used for heel and toe weighting or other major weight adjustment.

Various other modifications may be made without departing from the broader scope of the present invention.

What is claimed is:

1. A golf club sole plate comprising a thickened central portion and a thin plate-like portion surrounding said central portion, said central portion including a recess on the lower side thereof, said central portion further including a plurality of openings, at least some of said openings extending through said central portion from the upper surface to said recess, said sole plate further including weights and a removable cap, said weights being slideably engaged in said openings, said removable cap providing access to at least some of said weights.

2. The golf club sole plate of claim 1 wherein some of said weights are inserted from above said thickened portion, said weights each including a cylindrical portion and a head portion, said cylindrical portion being disposed within said openings which extend from the upper surface to said recess, and the remaining of said weights are inserted by first removing said cap.

3. The golf club sole plate of claim 1 wherein said removable cap is held in place by a screw which extends through said cap and is threadedly engaged in one of said plurality of openings.

4. The golf club sole plate of claim 3 wherein said impact block means is integral with said sole plate.

5. The golf club sole plate of claim 3 wherein some of said openings extend only through a portion of said impact block means.

6. The golf club sole plate of claim 1 wherein some of said openings extend only through a portion of said impact block means.

7. A golf club comprising a shaft, a grip disposed at one end of said shaft and a club head disposed at the other end of said shaft, said club head including a body portion, an impact block means disposed in said body portion and a sole plate, said impact block means having defined therein a plurality of openings and a plurality of weights disposed in certain of said openings, said impact block means being adapted for receipt of semi-permanent weights into said openings from above said impact block means and adapted for receipt of ready access weights into said openings from below said impact block means, said weights being slideably inserted in said openings, said sole plate and said impact block means being integral, said sole plate substantially covering the bottom of said club head, said sole plate including a removable cap for providing access to said ready access weights.

8. The golf club of claim 7 wherein some of said openings extend completely through said impact block means.

* * * * *